US008240652B2

(12) United States Patent
De Matteis

(10) Patent No.: US 8,240,652 B2
(45) Date of Patent: Aug. 14, 2012

(54) METHOD AND APPARATUS FOR SEPARATING PACKAGES OF INTERFOLDED SHEETS AT HIGH FLEXIBILITY

(75) Inventor: Alessandro De Matteis, Lucca (IT)

(73) Assignee: MTC-Macchine Trasformazione Carta S.R.L., Porcari (IT)

( * ) Notice: Subject to any disclaimer, the term of this patent is extended or adjusted under 35 U.S.C. 154(b) by 0 days.

(21) Appl. No.: 11/229,877

(22) Filed: Sep. 19, 2005

(65) Prior Publication Data

US 2006/0073007 A1 Apr. 6, 2006

(30) Foreign Application Priority Data

Sep. 22, 2004 (EP) ..... 04425706

(51) Int. Cl.
*B41L 1/32* (2006.01)

(52) U.S. Cl. ..... 270/39.02; 270/39.05; 270/52.07

(58) Field of Classification Search ..... 270/30.1, 270/30.01, 30.08, 30.09, 39.02, 39.05, 52.07; 493/345, 359, 411, 412, 424; 414/789.9
See application file for complete search history.

(56) References Cited

U.S. PATENT DOCUMENTS

| | | | | |
|---|---|---|---|---|
| 4,721,295 | A | 1/1988 | Hathaway | 270/52.5 |
| 4,770,402 | A | 9/1988 | Couturier | 270/39 |
| 4,874,158 | A * | 10/1989 | Retzloff | 270/39.02 |
| 5,088,707 | A | 2/1992 | Stemmler | 270/39 |
| 5,730,695 | A | 3/1998 | Hauschild et al. | 493/416 |
| 6,322,315 | B1 * | 11/2001 | Schmidt et al. | 414/789.9 |
| 2002/0034435 | A1 | 3/2002 | Schmidt et al. | 414/789.9 |
| 2004/0126172 | A1 * | 7/2004 | Matteis | 400/578 |

FOREIGN PATENT DOCUMENTS

| | | |
|---|---|---|
| DE | 3927422 | 2/1991 |
| DE | 4419989 | 12/1995 |

* cited by examiner

*Primary Examiner* — Leslie A Nicholson, III
(74) *Attorney, Agent, or Firm* — Dennison, Schultz & MacDonald

(57) ABSTRACT

A method for separating two consecutive interfolded sheets, during the production of packages of paper products, even if there is present at least one tear-off line or "tab bond". The sheets are fed in an interfolded way from interfolding rollers on a table by means of suitable folding arms. At a predetermined height of the stack a first plurality of separators, arranged along the length of the stack and at opposite sides with respect to it, are inserted in the same stack. This introduction divides the formed stack from the growing stack. Between the separators and the table a side of a sheet stretching board is introduced. The formed stack is then arranged between the table and the sheet stretching board. These are lowered vertically and move away from each other autonomously from the separators up to cause the disengagement of the growing stack from the formed stack.

4 Claims, 5 Drawing Sheets

Fig. 3bis
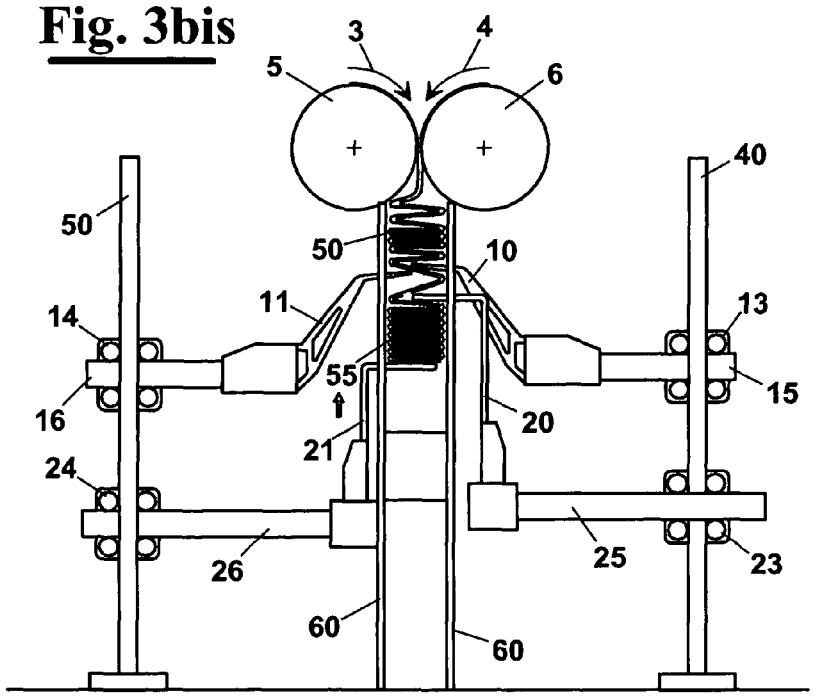

METHOD AND APPARATUS FOR SEPARATING PACKAGES OF INTERFOLDED SHEETS AT HIGH FLEXIBILITY

CROSS REFERENCE TO RELATED APPLICATIONS

This application claims priority of European Patent Application No. 04425706.1, filed Sep. 22, 2004, which application is incorporated herein by reference.

FIELD OF THE INVENTION

The present invention relates to the production of packages of paper material, and the like, and in particular it relates to a method for separating two successive stacks of interfolded sheets, which can be used both for fully cut sheets and for sheets with "tab bond" connection, to prepare packages with a predetermined number of sheets.

Furthermore, the invention relates to an apparatus that carries out this method.

BACKGROUND OF THE INVENTION

As known in the paper industry, a variety of types of machines and processes are used for making handkerchiefs, paper towels, and the like, in packages of interfolded sheets of a certain stack height.

Sheets of this type are obtained by stacking the sheets in an "interfolded" way, i.e., at each fold a wing of the previous sheet and a wing of the next sheet engage with each other. This way, when drawing a sheet from the package, a wing of the next sheet protrudes with subsequent practical employment for certain types of users. Among the possible interfolding ways the L, Z or W interfolded sheets are known respectively, with 2, 3 and 4 folds per sheet.

A particularly critical step of the process for production of packages of interfolded sheets, is separating a stack from the next one, once a predetermined height of the pack has been achieved. In the paper industry, high speed working is necessary during the whole production process, and the step of separating successive stacks of sheets represents a critical point of the whole process since it needs a succession of operations that unavoidably slows down productivity.

For this reason, solutions are looked for to provide high speed separating of the stacks.

The different existing apparatus all have a couple of folding rollers that supply the interfolded sheets on a table, and in some cases, a plurality of "folding arms" that go in and out special grooves made in the folding rollers, which forms a stack of interfolded sheets on the table.

In U.S. Pat. No. 4,770,402, when the stack of sheets present on the table reaches a certain height, a first series of means of separation moves into the stack from a side whereas a second plurality moves into the stack from the opposite side, and both for all its width. This way, a pack is separated from the next one, and the pack of predetermined height is precisely arranged between the table and the first series of means of separation. Whereas the other series of means of separation, supports the pack being formed up to the moment when the table comes back. The latter, in fact, leaves the pack with the predetermined height on a conveyor belt and moves back in the stack receiving position for receiving the pack.

These machines have, however, different drawbacks which are caused by the shape and the way of operating the means of separation.

Interfolded products also exist in which the sheets are connected through weak uncut portions, to assist the operation of the interfolding machine. The problem is that in separating two packages it causes tearing of such connections that would keep together two sheets of different packs.

Furthermore, the known interfolding machines can provide a single interfolded configuration, i.e., a single type of fold, and for this reason they have a process with little flexibility. In fact, for a determined type of interfolded product it is necessary to arrange the interfolding machine in such a configuration that its different separating and folding elements are arranged in appropriate relative positions in order to follow a determined succession of steps during the production process.

SUMMARY OF THE INVENTION

It is therefore a feature of the present invention to provide a method for separating a package from a stack of interfolded sheets, during the production of packages of interfolded sheets of paper products, which also provides the separation of two successive sheets having a connection of the "tab bond" type.

It is another feature of the present invention to provide a method for separating a package from a stack of interfolded sheets, during the production of packages of interfolded sheets of paper products. This invention allows the production process to be adaptable to different types of interfolded configurations and different folds.

It is a further feature of the present invention to provide an apparatus for separating a package from a stack of interfolded sheets, during the production of packages of interfolded sheets of paper products that has the same advantages of the method.

These and other objectives are accomplished with the method, according to the present invention, for separating a package from a stack of interfolded sheets, during the production of packages of paper products, comprising the steps of:

- forming in a vertical direction a stack of interfolded sheets on a table located underneath;
- separating two successive sheets once a predetermined height of the growing stack is achieved, by dividing a formed stack from a growing stack, said separation being caused by at least one separator suitable for entering laterally in the stack in order to physically detach the formed stack;
- laterally inserting a sheet stretching board between a separator and the table for completing the separation of the formed stack from the growing stack; and,
- lowering the formed stack by the table and arranging the same stack on an exit means;
- whose main feature is the step of laterally inserting said sheet stretching board comprises:
- laterally moving the sheet stretching board for at least one portion of the width of the stack between said separator and the table;
- lowering the sheet stretching board along with the table and the formed stack contained between them, then moving away from the separator that is supporting the growing stack, said moving away causes the separation of two interfolded sheets and the release of at least one wing hanging from the growing stack;
- moving upwards the sheet stretching board back to the growing stack below said separator; and, laterally moving the sheet stretching board up to stretch the wing hanging from the growing stack to prepare for return of the table.

Advantageously, before the moving upwards step, a withdrawing step is provided wherein the sheet stretching board moves to a position external to the formed stack.

In particular, a full transfer cycle of a stack of interfolded sheets comprises (after the moving upwards step) the further steps of:

withdrawing said separator up to a position external to the stack; and, moving back the table, and withdrawal of the sheet stretching board.

In particular, the succession of steps, as above described, can be used also for separating the formed stack from the growing stack, even if at least one connection of the "tab bond" type is provided. In this case, the separation of two successive sheets is made at the "tab bond" connection, or tear-off line.

Advantageously, in addition to the step of laterally inserting the sheet stretching board a step is also provided of laterally inserting an auxiliary stretching board from an opposite side. The operation of the auxiliary stretching board increases the flexibility of the interfolding machine since it allows different interfolded configurations. This includes Z, V, W folds and other types of folds, in addition to the possibility of processing interfolded sheets with or without a "tab bond" connection.

Advantageously, before the step that includes lowering of the sheet stretching board and the table, the following step is provided that comprises:

raising the table toward the sheet stretching board up to a determined distance at which point they compress the formed stack between them.

According to another aspect of the invention an apparatus for separating a package from a stack of interfolded sheets, during the production of packages of paper products, comprises:

means to provide a stack of sheets in an interfolded arrangement;

a movable table for a progressive growth of the stack and for transferring of a formed stack;

at least a separator suitable for laterally moving into the stack and to provide a temporary support for the growing stack; and, a sheet stretching board suitable for working between the separator and the table for completing the separation of the formed stack from the growing stack;

whose main feature is that the sheet stretching board has autonomous drive means for moving it independently in a vertical direction on the interfolding machine.

In particular, the autonomous drive means for independently moving the sheet stretching board comprises a carriage sliding independently along a guide, arranged vertically with respect to the interfolding machine, and respective means for actuating the carriage. This allows the separator and the sheet stretching board to work synchronously, but independently. The freedom of movement between the separator and the sheet stretching board of the interfolding machine allows a wide variety of different folding configurations to be obtained. This can be achieved by programming the electronics of the machine in order to synchronize the motion of the different boards according to the desired interfolding configuration, without the need of a substantial change of the mechanics of the same machine.

In particular, the table and the sheet stretching board can move towards or away from each other along a vertical direction. Furthermore, they can be moved vertically up to a determined distance to compress the formed stack between them. This allows the air present in the formed stack to be expelled in order to achieve higher efficiency, and avoids any further operations regarding compression of the stack before the packaging steps.

In an exemplary embodiment of the invention, in addition to the sheet stretching board an auxiliary stretching board is provided suitable for assisting the sheet stretching board and for cooperating with it, which can provide a desired interfolded configuration or a particular type of fold.

The separation of the formed stack from the growing stack is effected in such a way to sensibly reduce the presence of wings of sheets hanging free during the production process of the packages of interfolded sheets with respect to the solutions of prior art. This permits the reduction of the incidence of fouled product, and to provide a final product of high quality.

In particular, the auxiliary stretching board can be movable in a vertical direction integrally to the separator that is located at the same side with respect to the stack of sheets, and independently from it along a lateral direction.

BRIEF DESCRIPTION OF THE DRAWINGS

Further characteristics, and the advantages of the method and of the apparatus, according to the invention for separating a package from a stack of interfolded sheets, during the production of packages of interfolded sheets of paper products, will be made clearer with the following description of exemplary embodiments thereof, exemplified but not limited, to the attached drawings. Like reference characters designate the same or similar parts throughout the figures, of which.

DETAILED DESCRIPTION OF THE INVENTION

Figure 1:
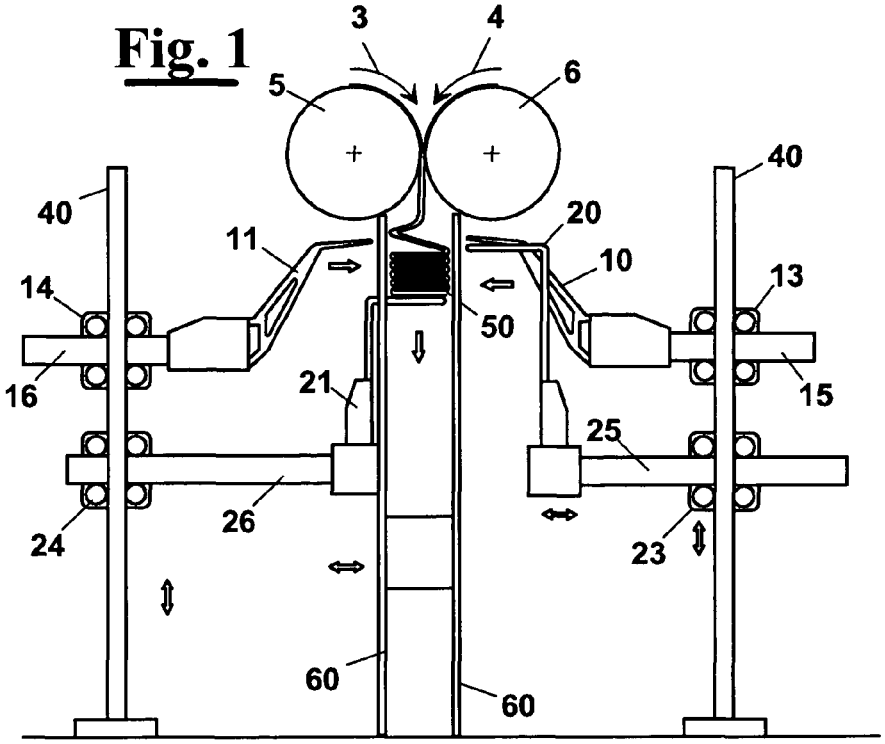
FIGS. 1 through 8 show diagrammatically a possible succession of steps, through which the method is carried out for separating two consecutive interfolded sheets, during the production of packages of paper products according to the invention; and, FIG. 3bis shows diagrammatically a possible step, preliminary to the step of separating the two stacks of interfolded sheets, where the table approaches the sheet stretching board and the stack between them is compressed.

In FIGS. 1 through 10, a succession of steps is diagrammatically shown through which a method is carried out for separating two consecutive interfolded sheets, during the production of packages of paper products, even if at least one tear-off line or "tab bond" is present, according to a possible exemplary embodiment of the invention. It provides feeding two webs of sheets according to arrows 3 and 4 on a couple of folding rollers 5 and 6 counter rotating and arranged with a plurality of means, not shown, which hold selectively the sheets on their surface.

As known, by means of suitable folding arms (which are also not shown), the sheets are fed in an interfolded way by rollers 5 and 6 on a table 21 on which a stack 50 grows. Stack 50 is contained laterally between two vertical grids 60 that define a production column, at the bottom of which, a conveyor (not shown) is provided.

Figure 2:
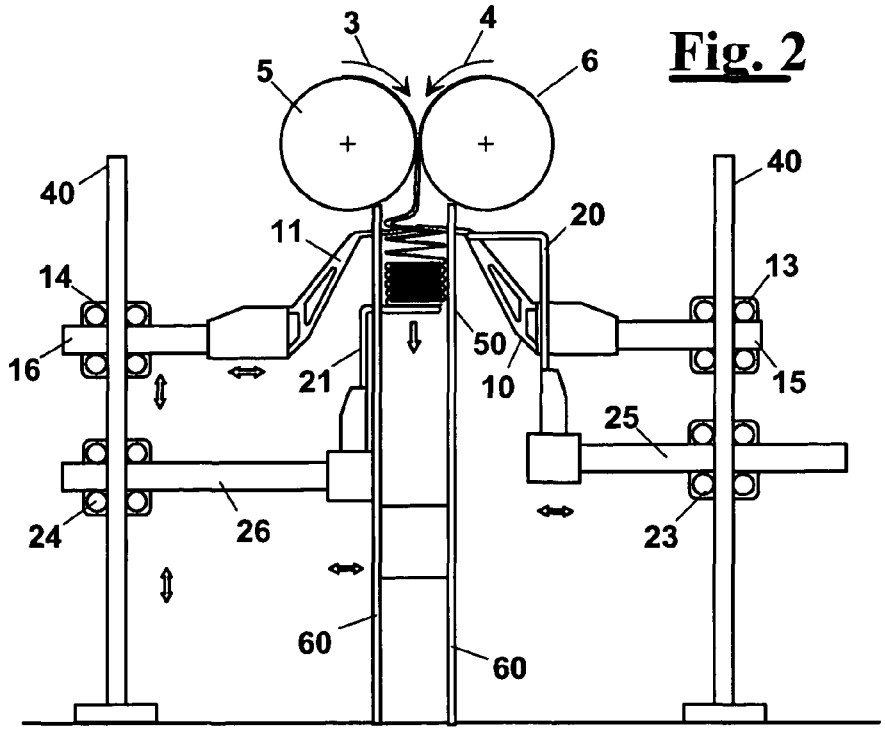
Figure 5:
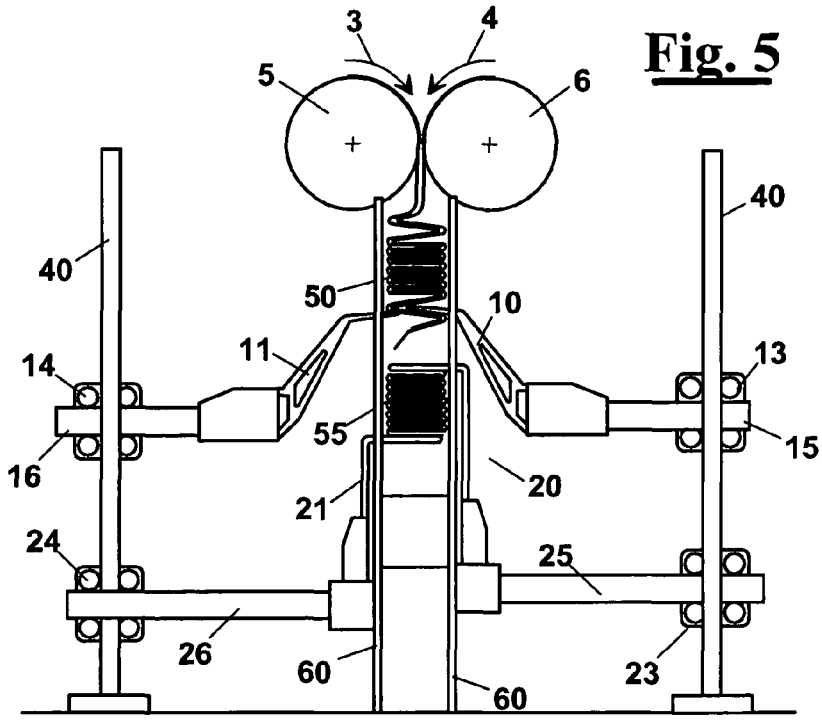
Figure 6:
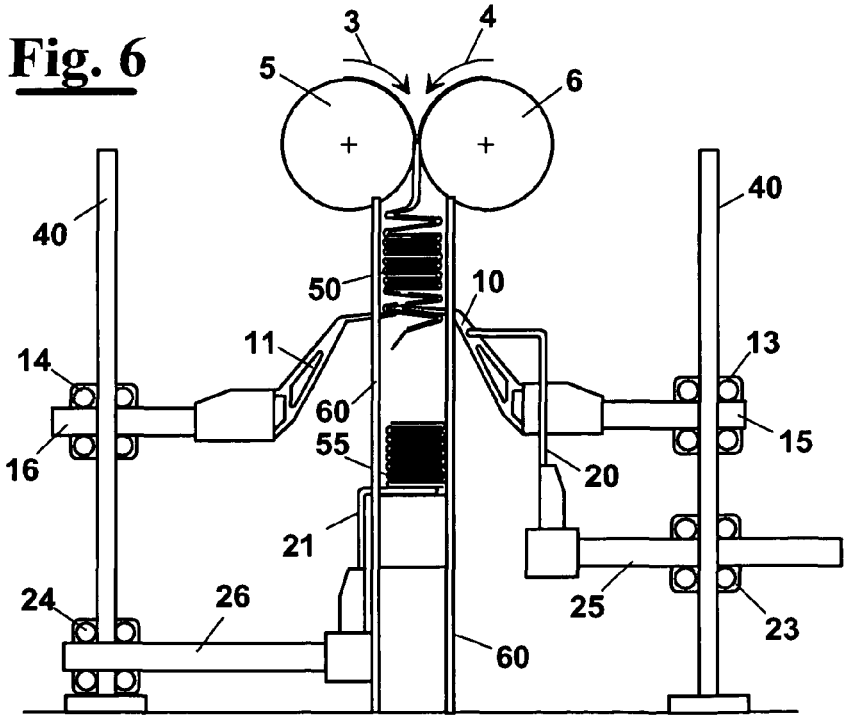
Figure 7:
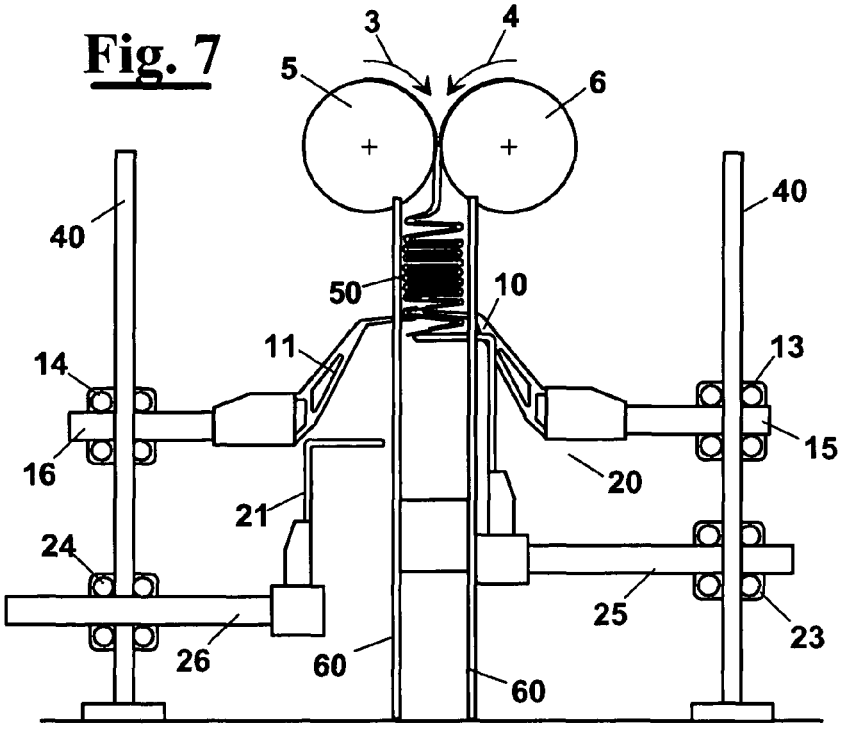
Figure 8:
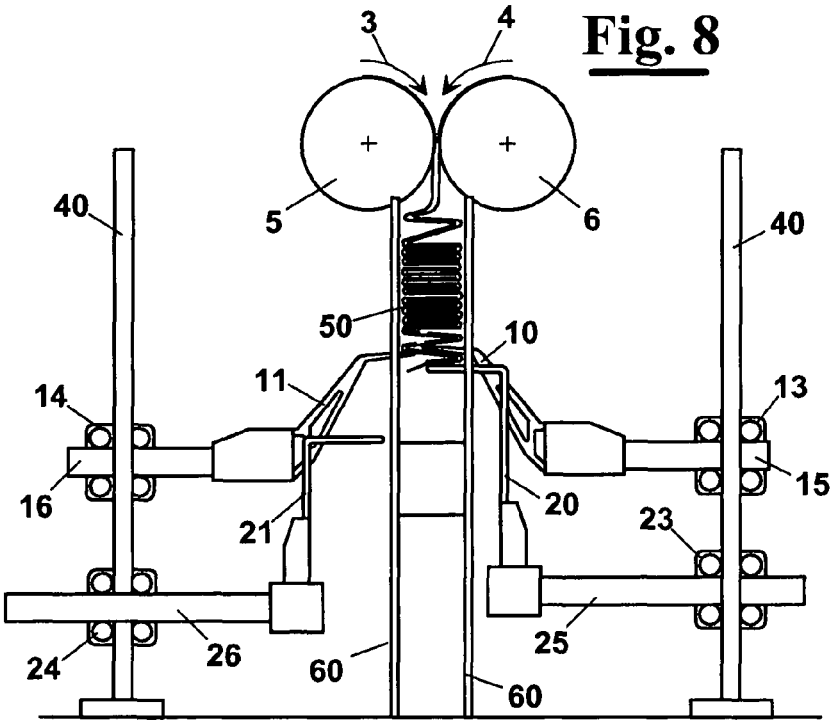

When stack 50 achieves a predetermined height, a first plurality of separators 10 and a second plurality of separators 11, arranged for the entire length of stack 50, and at opposite sides with respect to it, are inserted in the stack same (FIG. 2). This insertion divides a formed stack 55 from growing stack 50 (FIG. 5).

Figure 3:
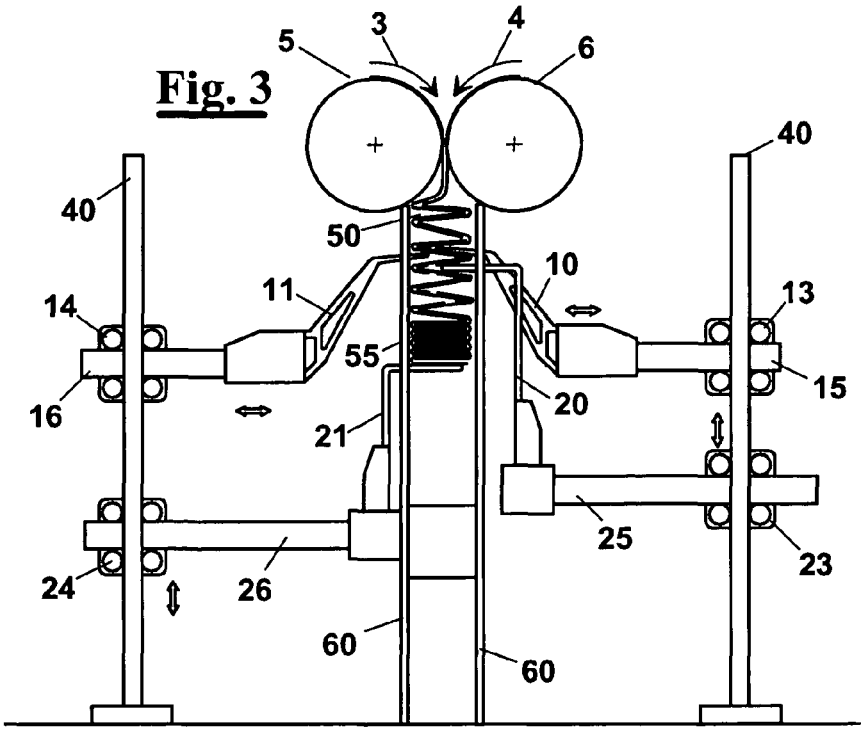
Figure 4:
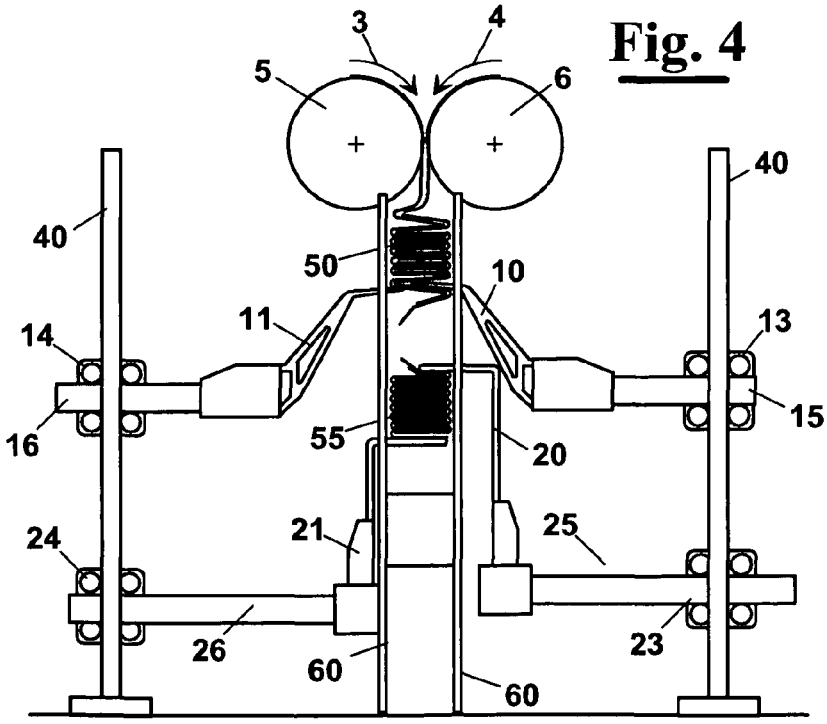

Formed stack 55 is then progressively lowered from growing stack 50 before eventually reaching a conveyor belt located underneath (not shown), where it is transferred out from the machine and then subject to further packaging operations. The lowering of formed stack 55 from growing stack 50 is effected by a table 21, and a sheet stretching board 20, among which the same formed stack is constrained. In particular, the sheet stretching board is put between separators 10 and 11, and table 21, and follows the latter during the separation and lowering steps. The disengagement occurs, according to the relative position of two successive sheets and the separators, by disengaging the interfolded sheets or breaking the tear-off or "tab bond" line. Before moving the two stacks 50 and 55 away from each other, causing the separation as above described, formed stack 55 can be pressed between table 21 and sheet stretching board 20 (FIG. 3). This optional step, executed by the return of table 21 towards sheet stretching board 20, allows the air present between the interfolded sheets of the same stack to be expelled, and to provide a means of separating formed stack 55 from growing stack 50 with the maximum efficiency. Table 21 and sheet stretching board 20 then move vertically towards the growing stack and then move away from it, in order to cause the disengagement of formed stack 55. During the combination of movements between table 21 and sheet stretching board 20, the separators 10 and 11 support growing stack 50.

The combination of movements described above is allowed by the particular structure of the interfolding machine, according to the invention. In fact, the elements that carry out the separation of two successive stacks of interfolded products, in particular separators 10 and 11 and sheet stretching board 20, are equipped with independent drives. In a possible exemplary embodiment shown in FIGS. 1 through 9, each separator 10 and 11, the sheet stretching board 20, and the table 21 are mounted on independent carriages, 13, 14, 23 and 24, respectively, which slide vertically along guides 40 and laterally along guides 15, 16, 25 and 26 within the machine. Furthermore, sheet stretching board 20 is mounted on a carriage sliding independently from table 21. In addition to the succession of steps described above, the movement of table 21, independent from sheet stretching board 20, allows the arrangement of the machine in many different configurations in order to provide a variety of products by simply programming the electronics of the machine. This makes possible, in particular, a way to provide an increased variety of interfolded configurations and of different types of folds.

Even if in FIGS. 1 through 9, as above described, a single sheet stretching board is shown, in any case, an auxiliary sheet stretching board (not shown) can be used, acting opposite to it. The operation of the auxiliary stretching board increases further the flexibility of the interfolding machine since it permits different interfolded configurations, among which Z, V, W folds and other types of folds. Additionally, it contributes the possibility of processing interfolded sheets with or without "tab bond" connection type.

The foregoing description of a specific embodiment will so fully reveal the invention according to the conceptual point of view, so that others, by applying current knowledge, will be able to modify and/or adapt for various applications such an embodiment without further research and without parting from the invention. Therefore, it is to be understood that such adaptations and modifications will have to be considered as equivalent to the specific embodiment. The means and the materials to realize the different functions described herein could have a different nature without, for this reason, departing from the field of the invention. It is to be understood that the phraseology or terminology employed herein is for the purpose of description and not of limitation.

What is claimed is:

1. A method for separating a package from a stack of interfolded sheets, during the production of packages of paper products, comprising the steps of:

feeding a succession of sheets, where at least two successive sheets are connected by a tab-bond connection;

forming in a vertical direction an interfolded stack of said sheets on a table located underneath wherein all sheets of the stack are interfolded with respect to each other;

separating two successive sheets once a predetermined height of the growing stack is achieved in such a way that a formed stack is separated from a growing stack, said separation at said tab-bond caused by moving first and second separators laterally into the stack from opposite sides with respect to the stack in order to physically detach the formed stack from the growing stack and to tear said tab-bond;

said stacks having a width, and said first and second separators are introduced in said stack for about a half of said width, such that said first and second separators support together said growing stack, each for about half of said width;

laterally inserting a single sheet stretching board distinct from said first and second separators between said first and second separators and the table for completing the separation of the formed stack from the growing stack;

progressively lowering the formed stack by the table; wherein said laterally inserting step of said sheet stretching board comprises:

while said first and second separators have been introduced for about half of said width for supporting together said growing stack, laterally moving said single sheet stretching board for at least one portion of the width of said stack under said first and second separators and between said separator and said table;

lowering said single sheet stretching board, along with said table and said formed stack, which is arranged between them, while moving away from said first and second separators that support the growing stack, said moving away travel of said sheet stretching board along with said table and said formed stack from said first and second separators introduced for about a half of said width causing the separation of the interfolded sheets and causing said tab-bond to tear, in such a way that the release of said at least one wing is obtained hanging from said growing stack;

moving upwards said single sheet stretching board independently from said table, back to said growing stack below said separators, said single sheet stretching board withdrawing to a position external to said formed stack;

laterally moving said single sheet stretching board from a position external to said formed stack up to under the forming stack and stretching said hanging wing of said growing stack for preparing the return of said table;

wherein prior to said step of lowering said single sheet stretching board and said table, a step is provided of:

approaching said table and said sheet stretching board up to arrange them at a determined distance at which they compress said formed stack between them.

2. The method, according to claim 1, wherein a full transfer cycle of a stack of interfolded sheets comprises, which occurs after said moving upwards step, the further steps of:

withdrawing said first and second separators up to reaching a position external to said growing stack;

moving back said table and withdrawal of said single sheet stretching board.

3. An apparatus for separating a package from a stack of interfolded sheets, during the production of packages of paper products comprising:

a means to provide a succession of sheets where at least two of said sheets are connected by a tab-bond connection;

a means for stacking said sheets in an interfolded arrangement, wherein all sheets of the stack are interfolded with respect to each other;

a movable table for a progressive growth of the growing stack and for transferring a formed stack;

a first separator and a second separator suitable for laterally moving into the stack and from opposite sides with respect to the stack in order to physically detach the formed stack from the growing stack; each of said stacks having a width and said first and second separators being configured to be introduced into said stacks for about a half of said width, said first and second separators being arranged to support together said growing stack;

a single sheet stretching board distinct from said first and second separators suitable for working between said first and second separators and the table for completing the separation of the formed stack from the growing stack by causing said tab-bond to tear; wherein said single sheet stretching board has autonomous drive means for moving it independently with respect to said first and second separators in a vertical direction, and in a horizontal direction with respect to said stack, in such a way that said single sheet stretching board can be moved from a position that is external to said formed stack up to under the forming stack and can stretch said hanging wing of said growing stack for preparing the return of said table while said first and second separators support said growing stack, each for about half of said width;

wherein said table and said single sheet stretching board can move towards/away from each other along said vertical direction in such a way that said first and second separators and said sheet stretching board are adapted to tear said tab-bond for leaving at least one wing of sheet hanging free between said first and second separators, said wing hanging at about half of said width, and said single sheet stretching board being configured to follow said table until said tab-bond is torn, and then return upwards independently from said table to fold said hanging wing under said first and second separators;

wherein said table and said sheet stretching board are arranged to approach each other at a determined distance at which they can compress a formed stack between them, prior to a lowering movement of said sheet stretching board and said table.

4. The apparatus, according to claim 3, wherein said autonomous drive means for moving it independent from said single sheet stretching board comprises an independent carriage sliding along a guide arranged vertically to said interfolding machine, and respective means for actuating said carriage.

* * * * *